US008402701B2

(12) United States Patent
Arteon

(10) Patent No.: US 8,402,701 B2
(45) Date of Patent: Mar. 26, 2013

(54) ANCHOR FOR HANDLING BUILDING ELEMENTS, IN PARTICULAR A CONCRETE PANEL

(76) Inventor: Marcel Arteon, Bayonne (FR)

( * ) Notice: Subject to any disclaimer, the term of this patent is extended or adjusted under 35 U.S.C. 154(b) by 0 days.

(21) Appl. No.: 13/288,410

(22) Filed: Nov. 3, 2011

(65) Prior Publication Data

US 2012/0067001 A1 Mar. 22, 2012

Related U.S. Application Data

(62) Division of application No. 12/519,537, filed as application No. PCT/FR2006/002860 on Dec. 22, 2006, now abandoned.

(51) Int. Cl.
*E04G 21/14* (2006.01)
*E04B 1/38* (2006.01)

(52) U.S. Cl. ..... 52/125.2; 52/125.4; 52/713

(58) Field of Classification Search ..... 52/122.1, 52/125.1, 125.2, 125.3, 125.4, 125.5, 125.6, 52/699, 700, 701, 703, 708, 712, 713, 715
See application file for complete search history.

(56) References Cited

U.S. PATENT DOCUMENTS

| | | | | | |
|---|---|---|---|---|---|
| 840,804 | A | * | 1/1907 | Prescott | 52/699 |
| 977,753 | A | | 12/1910 | Schumann | |
| 1,625,604 | A | | 4/1927 | Hersee | |
| 1,692,167 | A | * | 11/1928 | Gates | 249/215 |
| 1,962,906 | A | * | 6/1934 | Mueller | 52/564 |
| 1,989,811 | A | | 2/1935 | Kulp et al. | |
| 2,588,631 | A | * | 3/1952 | James | 52/713 |
| 2,724,165 | A | | 11/1955 | Williams | |
| 3,095,672 | A | | 7/1963 | Tullio et al. | |
| 3,234,703 | A | | 2/1966 | Sullivan, Jr. | |
| 3,290,983 | A | | 12/1966 | Peterson | |
| 3,339,328 | A | | 9/1967 | Hinchliffe | |
| 3,817,005 | A | * | 6/1974 | Rannefeld | 52/712 |
| 4,086,014 | A | * | 4/1978 | Jalaguier | 411/514 |
| 4,720,952 | A | * | 1/1988 | Fricker | 52/235 |
| 4,756,136 | A | * | 7/1988 | Hodges | 52/687 |
| 4,764,072 | A | | 8/1988 | Atack | |
| 4,924,648 | A | | 5/1990 | Gilb et al. | |
| 5,011,440 | A | * | 4/1991 | Lee | 439/857 |
| 5,096,444 | A | * | 3/1992 | Lu et al. | 439/750 |
| 5,596,846 | A | | 1/1997 | Kelly | |
| 5,625,993 | A | * | 5/1997 | Kelly | 52/704 |
| 5,743,062 | A | | 4/1998 | Fricker | |
| 6,071,144 | A | * | 6/2000 | Tang | 439/426 |
| 6,125,604 | A | | 10/2000 | Holmes | |

(Continued)

FOREIGN PATENT DOCUMENTS

| | | |
|---|---|---|
| AU | 199894225 B2 | 6/1999 |
| AU | 200027607 B2 | 10/2000 |

(Continued)

*Primary Examiner* — Brian Glessner
*Assistant Examiner* — Joseph J Sadlon
(74) *Attorney, Agent, or Firm* — Leydig, Voit & Mayer, Ltd.

(57) ABSTRACT

A handling anchor for lifting, raising, turning over, transporting, and laying building elements, such as precast blocks or panels, essentially made of concrete and to be connected to a building element. The anchor includes a connecting head for connecting the building element to a handling machine, and a body portion including active parts that, when the anchor is connected to the construction element, ensure the adhesion of the anchor to the material of the building element. The body includes at least one land including at least one face.

6 Claims, 6 Drawing Sheets

U.S. PATENT DOCUMENTS

| | | | | |
|---|---|---|---|---|
| 6,233,883 | B1 | 5/2001 | Artéon | |
| 6,334,284 | B1 * | 1/2002 | Provitola | 52/698 |
| 6,393,789 | B1 * | 5/2002 | Lanclos | 52/378 |
| 7,111,432 | B2 | 9/2006 | Hansort | |
| 7,237,368 | B2 | 7/2007 | Richardson et al. | |
| 2004/0159069 | A1 | 8/2004 | Hansort | |
| 2005/0055958 | A1 | 3/2005 | Hansort | |
| 2006/0112659 | A1 * | 6/2006 | Lindner et al. | 52/712 |
| 2006/0248813 | A1 | 11/2006 | Fletcher et al. | |
| 2011/0000148 | A1 | 1/2011 | Arteon | |

FOREIGN PATENT DOCUMENTS

| | | | |
|---|---|---|---|
| DE | 1215870 | | 5/1966 |
| EP | 1 712 705 | A2 | 10/2006 |
| FR | 2.177.488 | | 9/1973 |
| FR | 2 749 603 | A1 | 12/1997 |
| GB | 800302 | | 8/1958 |
| NZ | 221730 | | 3/1992 |
| WO | WO 90/10764 | A1 | 9/1990 |

* cited by examiner

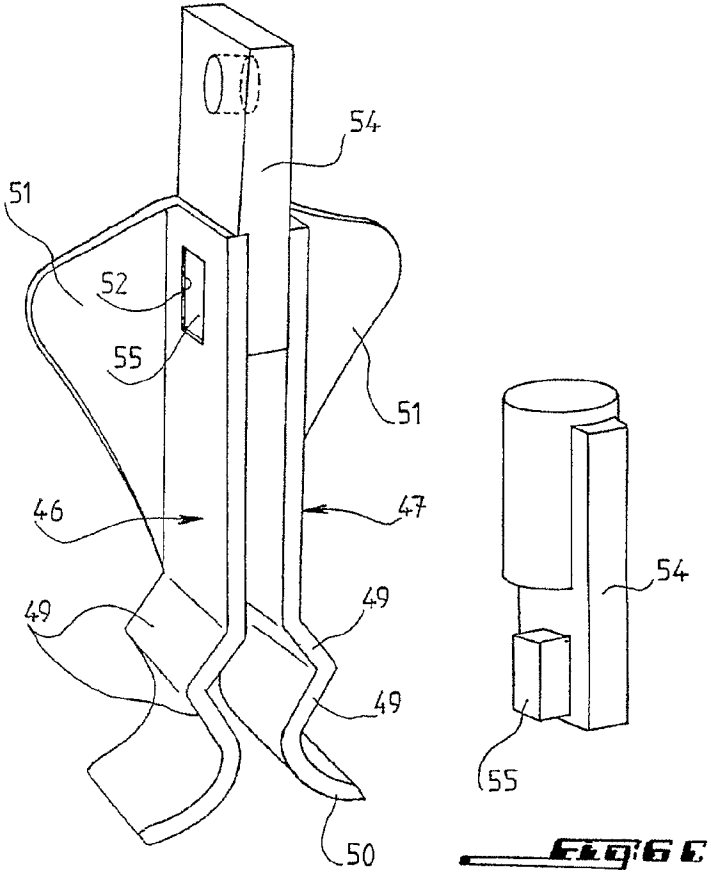
FIG. 6C
FIG. 6B
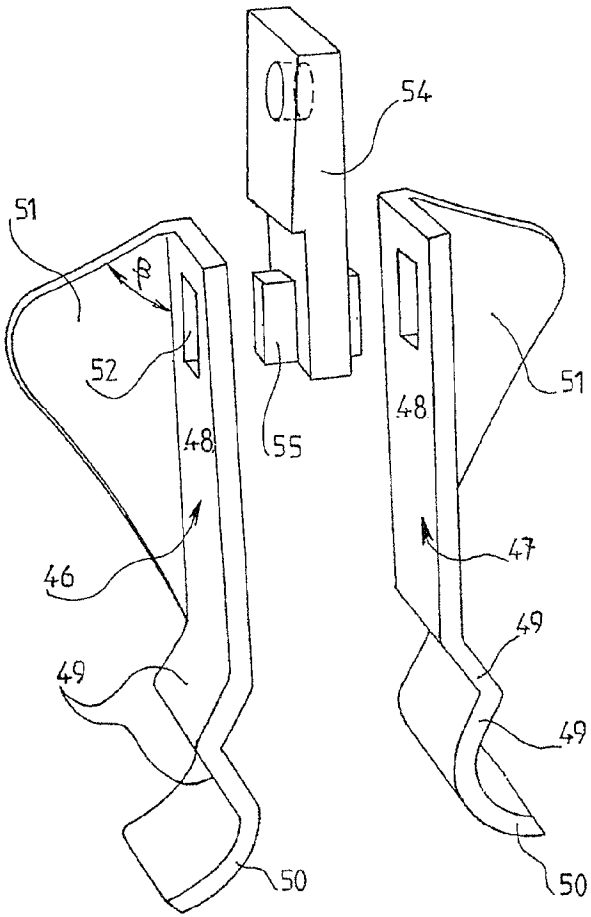
FIG. 6A

ANCHOR FOR HANDLING BUILDING ELEMENTS, IN PARTICULAR A CONCRETE PANEL

FIELD OF THE INVENTION

The invention relates to a handling anchor, notably for raising lifting, turning over, transporting and laying building components, such as prefabricated blocks and panels notably in concrete, intended to be made integral with the building member and of the type comprising a head for hooking up the building components to a handling machine and a body portion including active portions which, when the anchor is made integral with the building member, provides adhesion of the latter to the material of the building member.

BACKGROUND

The anchors of this type, which are known, have the drawback of being made according to relatively costly methods and therefore unsuitable for allowing adaptation of the shape of the anchor to the characteristics of the prefabricated components to be handled.

SUMMARY OF THE INVENTION

The object of the invention is to overcome this drawback. In order to achieve this goal, the anchor according to the invention is characterized in that its portion forming the body of the anchor includes at least one flat provided with at least two facets.

According to one feature of the invention, the anchor is characterized in that an aforementioned flat includes a plurality of facets which follow by forming a zigzagged sequence.

According to another feature of the invention, the anchor is characterized in that the anchor includes two flats assembled to each other.

According to another feature of the invention, the anchor is characterized in that the anchor includes a head for hooking up to a handling machine, which forms a separate part on which both flats are mounted.

According to still another feature of the invention, the anchor is characterized in that the flats have identical or different shapes.

According to still another feature of the invention, the anchor is characterized in that the member forming the head is of a different shape adapted to the means for gripping the anchor.

According to still another feature of the invention, the anchor is characterized in that it includes side wings, one of which protrudes from each flat.

According to still another feature of the invention, the anchor is characterized in that the wings are part of a separate part added on the anchor with assembled flats.

According to still another feature of the invention, the anchor is characterized in that the separate part has a central portion with a cross-section in the shape of an advantageously U-shaped adapted or circular groove in order to be engaged on the assembled flats.

According to still another feature of the invention, the anchor is characterized in that the aforementioned flat is axially cut out from its head in order to form two strips as a sequence of zigzagged facets, the corresponding facets of both sequences being tilted in opposite directions.

According to still another feature of the invention, the anchor is characterized in that the facets have a tilt angle relatively to the longitudinal direction of the anchor, an angle from 10 to 85°.

According to still another feature of the invention, the anchor is characterized in that the wings are part of a separate part which is provided with a foot portion and added on a head-forming part.

According to still another feature of the invention, the anchor is characterized in that the separate part includes a central portion with a cross-section in the form of a U-shaped groove for engaging on the head portion, advantageously in the form of a circular U.

According to still another feature of the invention, the anchor is characterized in that the central portion, the wings and the foot are obtained by folding an original blank component.

BRIEF DESCRIPTION OF DRAWING FIGURES

The invention will be better understood and other objects, details and advantages thereof will become more clearly apparent in the explanatory description which follows, made with reference to the appended schematic drawings, only given as an example illustrating several embodiments of the invention and wherein:

FIGS. 6A and 6B are perspective views of another embodiment of an anchor with two flats, in the exploded condition and in the assembled condition respectively;

FIG. 6C is a perspective view of an alternative embodiment of the head of an anchor according to FIGS. 6A and 6B;

DETAILED DESCRIPTION

The anchor devices according to the invention have been designed in order to allow handling, notably raising, lifting, turning over, transporting and laying, of building components such as prefabricated blocks or panels in concrete.

Figure 1:
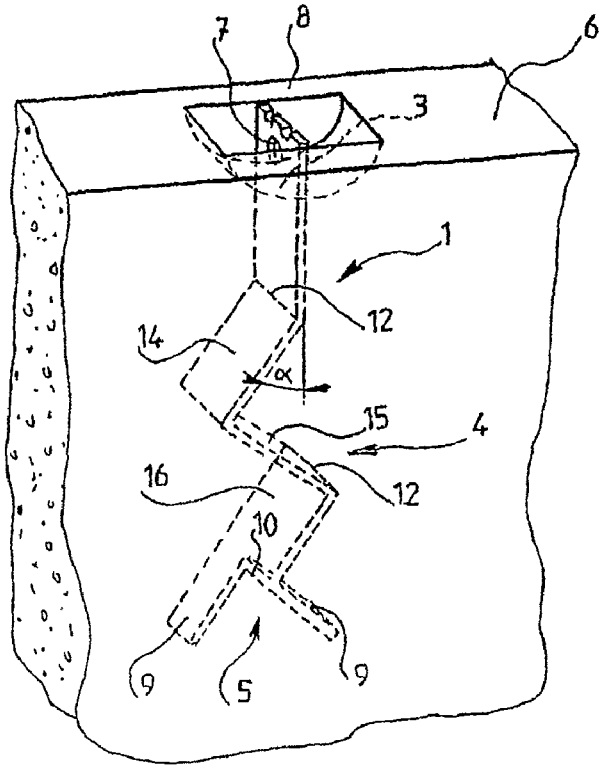
FIG. 1 is a perspective view of a first embodiment of the anchor according to the invention, formed by a single flat.

FIG. 1 shows a first embodiment of an anchor according to the invention generally designated by reference 1. The anchor according to FIG. 1 has the shape of a flat 1 made from a rigid metal strip and including a head portion 3, a portion 4 forming the body of the anchor and a portion 5 forming the foot. The anchor 1 is intended to be embedded in the material, generally concrete, of the building component 6 to be handled, except for the head 3 which remains outside the material of the building component and is adapted so as to be hooked to a handling machine. In the case of FIG. 1, the head includes a hole 7, by which the anchor may be grasped by a hook of the handling machine. The foot is dovetail-shaped. For this purpose, the lower end of the flat 1 is split in its axial direction in order to form two foot portions 9, with an advantageously equal width, one of which is folded around a folding line 10 in order to be separated from the other. The portion 4 forming the body of the flat 1 is folded around three folding lines which extend perpendicularly to the longitudinal axis of the flat. These lines marked as 12 are shifted from each other in the axial direction of the flat and thereby provide the formation of three tilted facets 14, 15, 16 which follow along the axis of the anchor formed by the flat, each facet forming a predetermined angle between 10° and 85° relatively to the longitudinal direction of the anchor.

The facets 14, 15, 16 combined with the developed surface of the flat allow the concrete to be stressed both upon adhesion and right-angled shearing of the anchorings generated by the facets. It should be noted that the flat head comprises discontinuities in its front face which are also provided on the other heads of this type without being however illustrated. It is noticed that the building component according to FIG. 1 is a concrete panel which may be of small thickness and that the flat is positioned in the panel so that its width is in the direction of the thickness of the panel. This excludes any risk of deformation of the anchor in the direction of its width.

Figure 2:
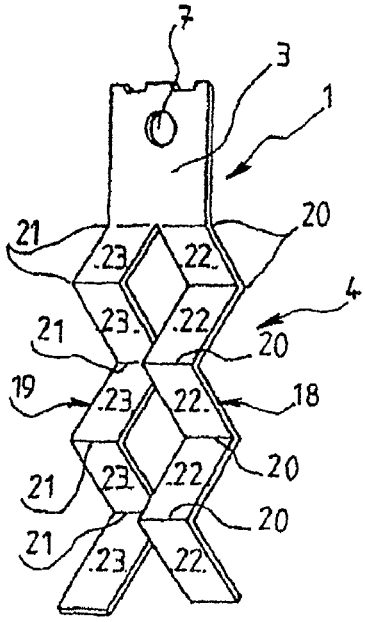
FIG. 2 is a perspective view of a second embodiment of an anchor formed with a single flat.

FIG. 2 illustrates another embodiment of an anchor formed from a single metal flat. The particularity of this embodiment lies in the fact that this flat is cut along the middle longitudinal line, from the foot end up to the head portion 3. Two flat components are obtained as strips 18, 19 with equal width, which are folded several times, in the illustrated example six times, around the folded lines 20 and 21, respectively, which extend perpendicularly to the longitudinal axis of the anchor and are spaced apart in this longitudinal direction. The folds of both flat elements 18, 19 are made in the opposite directions by an angle $\alpha$ from 10 to 85° so that each component has five successive facets forming a zigzagged strip. The facets of the strip 18 are all designated by reference 22 and those of strip 19 by the same reference 23.

It is easily understood that, by means of the multitude of facets, the anchor according to FIG. 1 and even more the anchor according to FIG. 2, are particularly suited to gradual tensile forces.

Figure 3A:
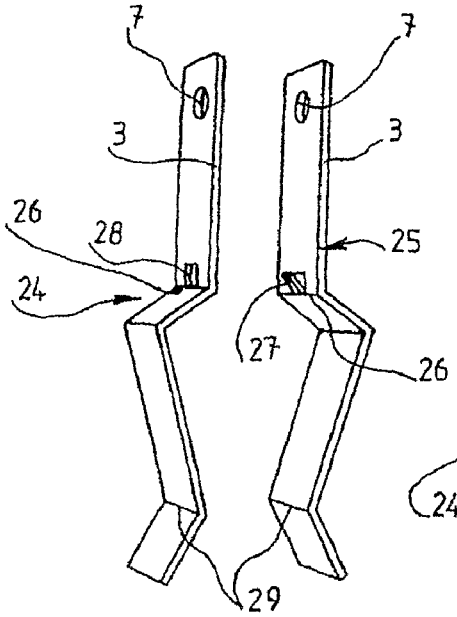
FIGS. 3A and 3B are perspective views, in the exploded condition and in the assembled condition, of another embodiment of an anchor according to the invention, the body being formed by two flats.
Figure 3B:
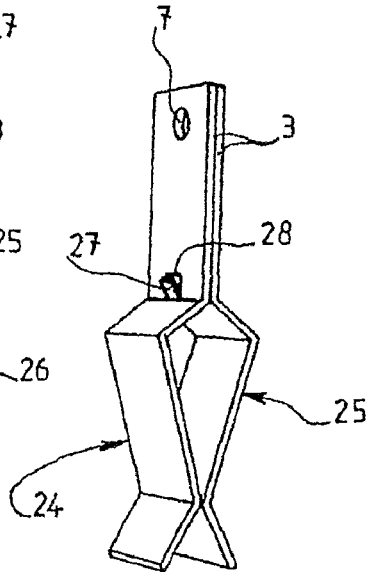

FIGS. 3A and 3B show an embodiment of an anchor according to the invention obtained by assembling two flats 24, 25, identical but with inverted configurations. Each flat has three successive zigzagged facets, from the head portion 3, in accordance with the embodiment according to FIGS. 1 and 2. One of the two flats, in the example illustrated, flat 25, includes just above the upper folding line 26, a cut-out assembly lug 27 in the strip and folded out of the plane of the latter, which, during the assembly of both flats, engages into a suitable recess 28 provided in the flat 24, as seen in FIG. 3A. In the assembled condition, the head portions 3 of the both flats are thus pressed against each other so that the head of the anchor in the assembled condition has a double thickness. Both of the anchor halves each formed by one of the flats 24, 25 are still in contact at their lower folding line 29. Of course, any other method for assembling both flats 24, 25, for example by spot welding or by adhesive bonding may be contemplated. The anchor with two flats according to FIGS. 3A, 3B, is particularly suitable for axial tensile forces.

Figure 4:
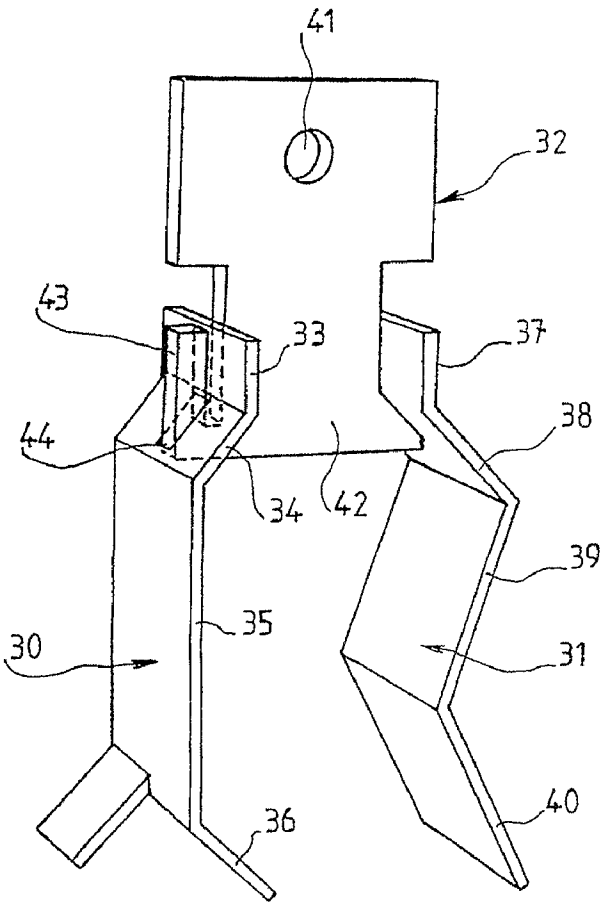
FIG. 4 is a perspective view of another embodiment of an anchor with two flats according to the invention.

FIG. 4 illustrates another embodiment of an anchor obtained from two different flats marked as 30, 31, mounted on a separated head component 33. In the illustrated example, both flats 30, 31 are always of the facet type, but with different configurations. Of course, both flats may also be configurations which are only inverted. In the illustrated example, the flat 30 includes from top to bottom, an upper portion 33, parallel to the axis of the anchor, a tilted portion 34, a portion 35 parallel to the portion 33 and a dovetail-shaped foot portion 36. The flat 31 includes a head portion 37 followed by three portions 38, 39, 40, which form a zigzagged assembly with three facets.

The separate head component 32 is in the shape of a plate, the upper portion of which includes a hole 41 for hooking up to a handling machine and a base portion 42 which includes on each lateral side a vertical lug 43 intended to pass, during the mounting of both flats 30, 31 on the head 32, through cut-outs 44 of complementary shape, provided in the respective tilted portion 33, 37 of both flats. Each lug 43 is cut out in the flat part 32 which forms the head. The lugs extend in the axis of the anchor and the bottom of the interior vertical cut-out extends up to a depth adapted to the tilt of the face 33 or 37 of the flat so that support from the flat is optimum.

Figure 5:
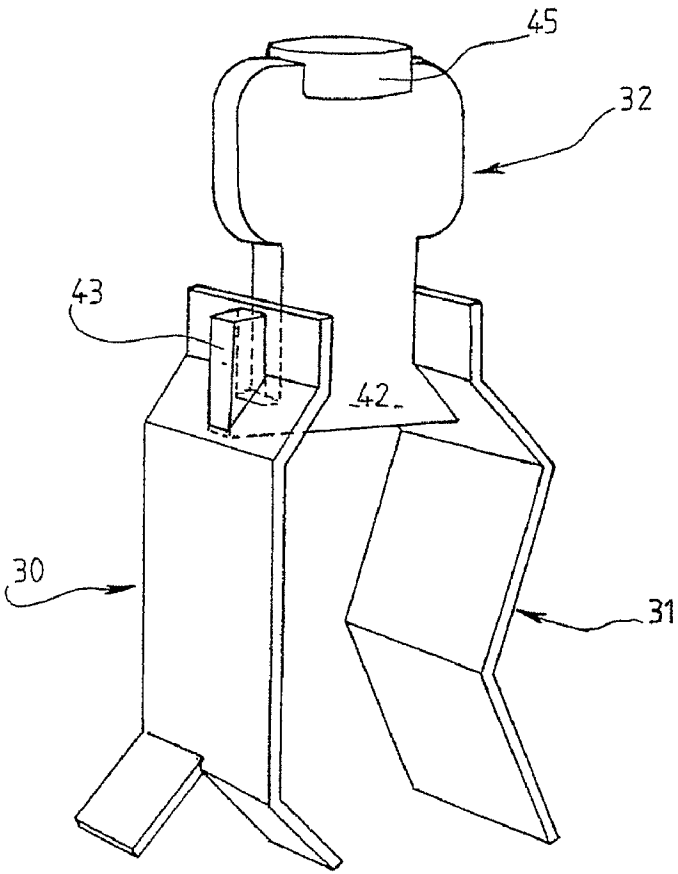
FIG. 5 is a perspective view of an anchor according to the invention, made according to the principle of FIG. 4 but including a different head.

With this structure of an anchor which may be achieved by mounting flats with either identical facets or not on a separated part, which then forms the head of the anchor, the shape of which may be selected according to the means for gripping the anchor, it is possible to obtain an anchor structure perfectly adaptable to conditions of its use. FIG. 5 confirms this observation as it shows an anchor, the head of which, instead of having the hole for letting through a hook, as in FIG. 4, is of the spherical type marked as 45. The anchor with two flats according to FIGS. 4 and 5 is particularly adapted for axial tensioning, lifting and turning-over forces.

FIGS. 6A-6C illustrate another embodiment of an anchor with two flats and separate head. Specifically with respect to FIGS. 4 and 5, each of both flats 46, 47 with inverted configurations comprises an anchor body, the upper portion of which 48 is rectilinear and the lower portion of which includes two tilted facets 49 so as to form a V and a sealing foot portion 50 obliquely extending away outwards, from the longitudinal middle plane of the anchor.

The particularity of this anchor structure according to FIGS. 6A, 6B lies in the fact that the upper rectilinear portion 48 includes delta side wings 51, i.e., having the general shape of a triangle and extending perpendicularly to the plane of the flat portion 48 outwards. These wings 51 may be obtained by folding a suitably shaped portion of the flat around a line then forming a longitudinal side edge of the rectilinear body portion 48. In the illustrated example, the wings 51 have the shapes of a triangle the free angle of which may be 90°. Generally, the shape of the triangle will be selected so that the tilt angle $\beta$ of the upper edge of the triangle will be relatively large in order to provide significant width in the upper portion of the flat.

Close to its upper end, each anchor flat 46, 47 includes in its rectilinear upper portion 48, a bore, for example of rectangular shape 52, for mounting the flat on a separate head member 54 which comprises, close to its base, on two opposite suitable side faces, a lug 55 with a parallelepipedal shape, complementary to the shape of the bore 52. As seen in FIG. 6B, assembling the head 54 and both flats 46, 47, is performed by engaging the flats, by means of their bores 52, on the protruding lugs 55 of the head. FIG. 6C has the purpose of showing the adaptability of the anchor to different applications. For this purpose, it is sufficient to select a head 54 with a suitable shape. In FIG. 6C, the head is of the spherical type made as a single piece, for example by forging. But the cylinder-shaped grip portion may also be added to a base portion by screwing or any other suitable way.

Figure 7B:
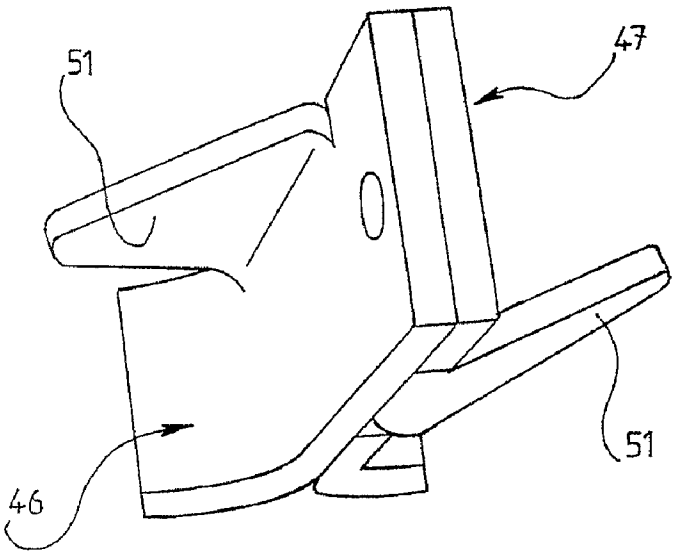
FIGS. 7A, 7B are perspective views of an alternative embodiment according to FIGS. 6A, 6B.
Figure 7A:
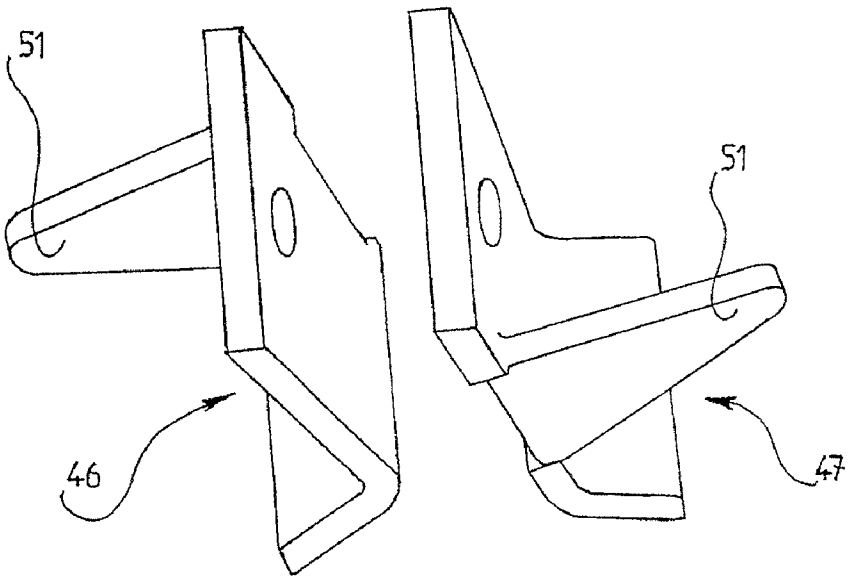

The anchor structure illustrated in FIGS. 6C-6C, by means of its wings 51 is particularly well suited to forces for lifting concrete panels, notably with small thickness. FIGS. 7A and 7B show that a structure of the type according to FIGS. 6A, 6B may also be obtained from two flats with identical shape. Assembling both of these flats results in a structure wherein the wings are positioned on opposite lateral sides of the anchor. In FIG. 7, the anchor does not include any separate head member. The head is of the type of the anchor according to FIG. 2. This illustrates once more the various possibilities provided by the invention for achieving anchor structures with different shapes, perfectly suitable for different applications, if necessary for specific applications.

Figure 8C:
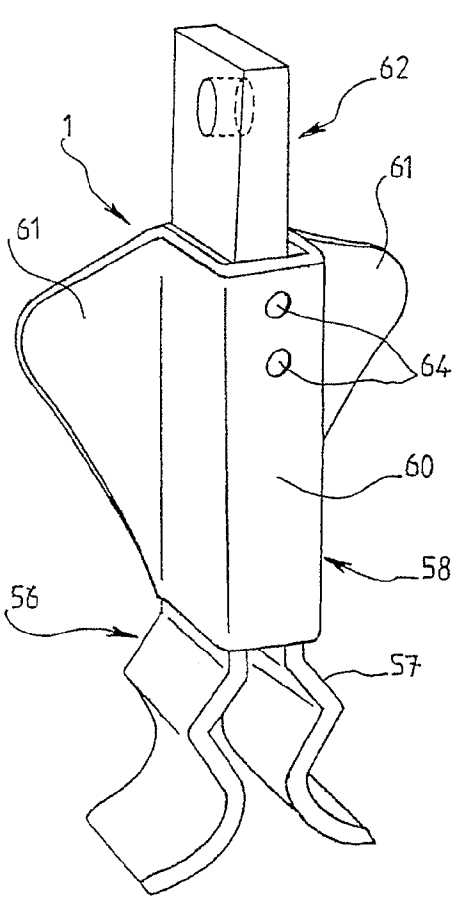
FIGS. 8A, 8B and 8C are perspective views of an embodiment of an anchor according to FIGS. 6A, 6B, 6C and FIGS. 9A, 9B and 9C are perspective views of an embodiment of an anchor according to FIGS. 8A, 8B.
Figure 8B:
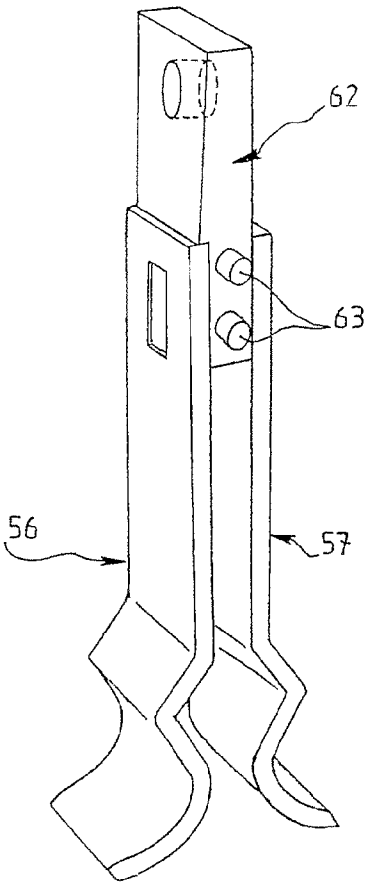
Figure 8A:
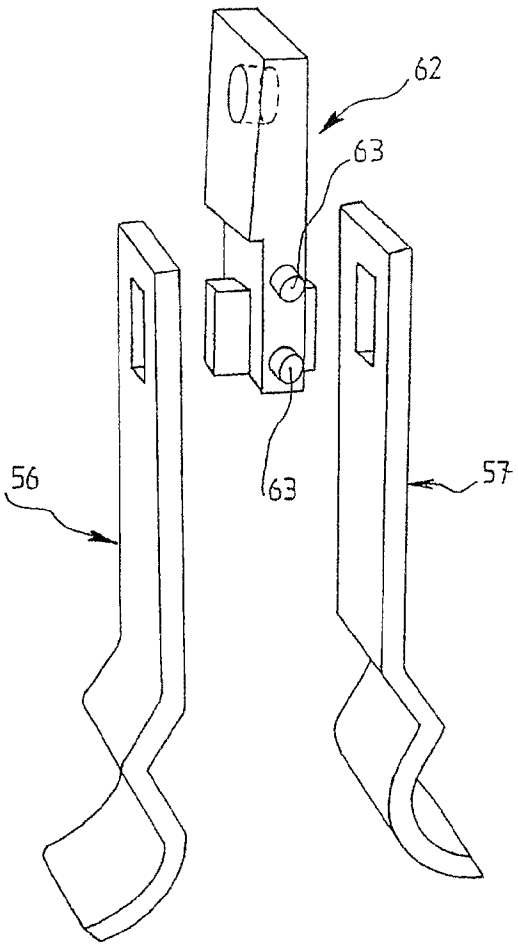

FIGS. 8A and 8B illustrate another possibility of making the delta wing anchor, as illustrated in FIGS. 6A and 6B. In this case, the delta wings 51 are formed by adding a part obtained by folding a metal sheet part 58 to the flats 56, 57 substantially having the shape of the flats 46, 47 without wings 51 of FIG. 6A. This part includes a central portion 60 in the shape of a U, the width of which is slightly larger than the width of both flats in the assembled condition and the height is complementary to the width of the flats, and delta-shaped wings 61 obtained by folding the free edges of the branches of the U, by an angle of 90°. For adding this part to the assembled set of flats, the latter and the head-forming part 62 include, in the illustrated example, protruding lugs 63 which engage with suitable bores 64 of complementary shape provided in the base of the central U-portion. Of course, the wing part may also be made in any other suitable way.

Figures 9A, 9B, 9C:
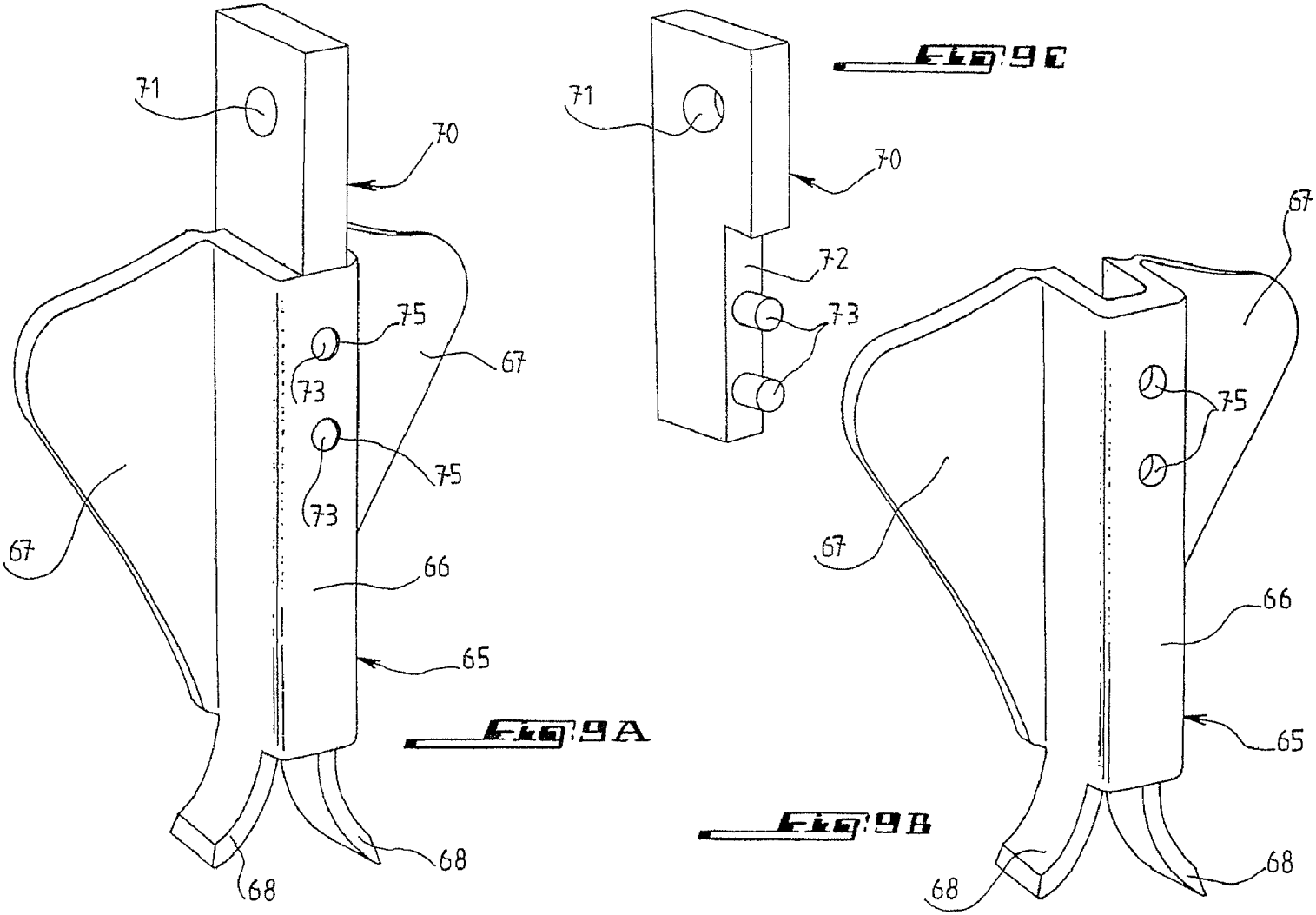

FIGS. 9A-9C illustrate an anchor which has the structure of the anchor according to FIGS. 8A-8C, but is only obtained from two parts, i.e., a part 65 which includes a U-shaped central portion, similar to the portion 60 of FIG. 8C, side wings 67 similar to the wings 61 and two tabs 68 which form a dovetail-shaped foot. It should be noted that the part 65 is advantageously obtained by cutting out and folding an original blank. The anchor further includes a head part 70 with a flat shape, provided with a grip hole 71 and including on its front cut face 72 retracted by a distance corresponding to the thickness of the central part 66, two assembly lugs 73 intended to be received in holes of complementary shape 75 in the base of the central component 66 of the part 65. As this emerges from the figures, the anchor is obtained by inserting the head 70 into the central portion 66, the widths of both parts being complementary. Of course, the cross-sections of the central portions 60 and 66 may be different, and for example circular.

Of course, these anchor structure possibilities are not limited to the different embodiments illustrated in the figures which have only been given as examples. Indeed, by its modular design which may use several flats of identical or different shapes, which are if necessary mounted on a head member with a suitable shape, the invention provides perfect adaptability to handling conditions of the building component, notably when these are concrete panels with a small thickness. Given that the anchor according to the invention may be made from flats and heads with simple shape, the cost price of the anchor is low although the performances of the anchor are excellent. It should be noted that deformation of the flats may be achieved in any suitable way, for example also by stamping.

As this emerges from the description which has just been made and from the figures, the anchor according to the invention has major advantages as compared with anchors of the state of the art. In this connection, it is essential that the anchor be formed by one or two flats with identical of different shapes, the section, length, width and height of which may be adjusted according to the technical geometrical characteristics of the panels. The one-piece-shaped joined or juxtaposed flats comprise one or more facets obtained by folding by an angle from 10 to 85°. These single or joined facet flats simultaneously increase the adhesion surface, stress the concrete upon compression by inner and outer faces of the facets and upon shearing at right angles to the anchorings. The anchor creates a compressed mass inside the facets in the case of joined flats. The anchor may operate during raising, lifting, turning over and oblique tensioning without notably adding strengthening irons. The head of the anchor may be of the spherical, flat, threaded bushing type, and may be connected to a lifting ring. The head of the anchor may be used for positioning the anchor before pouring the concrete.

The invention claimed is:

1. A handling anchor comprising:

a first element extending substantially in a first direction, the first element including a head for hooking the anchor to a handling machine, and a body portion integral with and extending from the head in the first direction, the body portion including active portions which, when the anchor is integral with a building component, provides adhesion of the anchor to the building component, wherein the body portion includes at least one transverse bend, a first generally planar active facet located beyond the bend and remote from the head in the first direction, and a second generally planar active facet located beyond the first generally planar active facet in the first direction so that the first generally planar active facet is located between the head and the second generally planar active facet, and the first and second generally planar active facets define a succession of facets extending from the head in the first direction in a zigzag pattern; and a second element including a head for hooking the anchor to the handling machine, and a body portion inversely bent relative to the body portion of the first element, wherein the heads of the first and second elements are in contact with each other, and the body portions of the first and second elements are in contact with each other at respective bends.

2. The handling anchor according to claim 1, wherein the first and second active facets are oblique relative to the head of the anchor and are tilted, relative to the head of the anchor, at angles in a range from 10° to 85°.

3. The handling anchor according to claim 1, wherein the head of the first element includes a lug cut from and protruding from the head of the first element, and the head of the second element includes an opening receiving the lug, thereby engaging the heads of the first and second elements.

4. A handling anchor comprising:

a first element including a generally planar head for hooking the anchor to a handling machine, the head including a lug cut from and protruding from the head, and a body portion integral with and extending from the head, the body portion including first, second, and third bends transverse to the head, the first bend separating the head from the body, and first, second, and third active facets extending, respectively, from the first, second, and third bends, the first, second, and third active facets, when the anchor is integral with a building component, providing adhesion of the anchor to the building component; and a second element including a generally planar head for hooking the anchor to the handling machine, and a body portion integral with and extending from the head, the body portion including first, second, and third bends transverse to the head, the first bend separating the head from the body, and first, second, and third active facets extending, respectively, from the first, second, and third bends, the first, second, and third active facets, when the anchor is integral with the building component, providing adhesion of the anchor to the building component, wherein the body portions of the first and second elements are bent, at the first, second, and third bends, inversely with respect to each other, the generally planar heads of the first and second elements are in contact with each other at respective planar surfaces, and the bodies of the first and second elements are in contact with each other at the first bends and at the third bends.

5. The handling anchor according to claim 4, wherein the first, second, and third active facets are oblique relative to the heads of the first and second elements of the anchor and are tilted, relative to the heads of the first and second elements of the anchor, at angles in a range from 10° to 85°.

6. The handling anchor according to claim 4, wherein the head of the second element includes an opening receiving the lug, thereby engaging the heads of the first and second elements.

* * * * *